US006948318B2

(12) United States Patent
Peyron

(10) Patent No.: US 6,948,318 B2
(45) Date of Patent: Sep. 27, 2005

(54) METHOD AND INSTALLATION FOR FEEDING AN AIR SEPARATION PLANT WITH A GAS TURBINE

(75) Inventor: Jean-Marc Peyron, Creteil (FR)

(73) Assignee: L'Air Liquide, Société Anonyme à Directoire et Conseil de Surveillance pour L'Etude et L'Exploitation des Procédés Georges Claude, Paris (FR)

( * ) Notice: Subject to any disclaimer, the term of this patent is extended or adjusted under 35 U.S.C. 154(b) by 107 days.

(21) Appl. No.: 10/478,544

(22) PCT Filed: May 17, 2002

(86) PCT No.: PCT/FR02/01673

§ 371 (c)(1),
(2), (4) Date: Nov. 20, 2003

(87) PCT Pub. No.: WO02/095310

PCT Pub. Date: Nov. 28, 2002

(65) Prior Publication Data

US 2004/0200224 A1 Oct. 14, 2004

(30) Foreign Application Priority Data

May 23, 2001 (FR) ..... 01 06838

(51) Int. Cl.[7] ..... F25J 3/04

(52) U.S. Cl. ..... 60/772; 60/781; 60/39.12; 60/785

(58) Field of Search ..... 60/785, 784, 39.12, 60/781, 772

(56) References Cited

U.S. PATENT DOCUMENTS 6,202,442 B1 * 3/2001 Brugerolle ..... 62/649
6,612,113 B2 * 9/2003 Guillard ..... 60/783

* cited by examiner

*Primary Examiner*—Ehud Gartenberg
(74) *Attorney, Agent, or Firm*—Linda K. Russell

(57) ABSTRACT

The invention concerns a method involving the intake (through 16) of air in an intake of an air separation plant (14), supplying (though 16) at least a fraction of the intake air from a gas turbine compressor section (2), and extracting from the air separation plant (16) two gas streams (through 20, 24, 32, and 36) respectively nitrogen-enriched and oxygen-enriched streams; detecting (through 18) a substantial decrease in the flow rate of the air fraction from the gas turbine compressor section (2), then recycling (through 28, 42), to the inlet of the air separation plant (14) at least part of one of the two gas streams, and thus avoiding any major fluctuation of the intake air flow rate of said air separation plant.

18 Claims, 4 Drawing Sheets

METHOD AND INSTALLATION FOR FEEDING AN AIR SEPARATION PLANT WITH A GAS TURBINE

FIELD OF THE INVENTION

The present invention relates to a method and a plant for feeding an air separation unit by means of a gas turbine.

RELATED ART

Conventionally, a gas turbine comprises a compressor, a combustion chamber and an expansion turbine coupled to the compressor in order to drive the latter. This combustion chamber receives a combustion gas, and a certain amount of nitrogen, intended to lower the flame temperature in this combustion chamber, which makes it possible to minimize the discharge of nitrogen oxides to the atmosphere.

In a known manner, the combustion gas may be obtained by gasification, that is to say by oxidation of carbon products, such as coal or else oil residues. This oxidation is carried out in an independent unit, called a gasifier.

Conventionally, it is possible to combine this gas turbine with an air separation unit. The latter, which is usually a cryogenic unit comprising at least one distillation column, enables at least one gas stream mostly consisting of one of the gases of air, especially oxygen or nitrogen, to be supplied from air.

Combining this air separation unit with the gas turbine involves making use of at least one of the two aforementioned gas streams. For this purpose, the oxygen and the nitrogen produced in the air separation unit are admitted respectively into the gasifier and the combustion chamber.

The aim of the invention is more particularly the combined implementation of a gas turbine and of an air separation unit, in which the inlet air delivered to this separation unit is at least in part supplied by the gas turbine.

To this end, the delivery circuit of the compressor of this gas turbine is brought into communication with the inlet of the separation unit, replacing or in addition to an external feed compressor. This arrangement is in particular described in FR-A-2 690 711.

However, this known solution has some drawbacks.

This is because it has been noticed that feeding the air separation unit by means of the gas turbine is likely to lead to a loss of purity of the gases produced in the separation unit, such as oxygen, nitrogen or argon, or even to an inadvertent shutdown of this separation unit.

In the latter case, this unit should then be restarted, which involves a consequent loss of time, together with considerable energy consumption.

SUMMARY OF THE INVENTION

The invention proposes overcoming these drawbacks. For this purpose, the subject of the invention is a method for feeding an air separation unit by means of a gas turbine, in which inlet air is admitted into an inlet of the said separation unit, at least a portion of the said inlet air is supplied from the said gas turbine, and two gas streams, enriched respectively with nitrogen and with oxygen, are extracted from the separation unit, characterized in that an appreciable decrease is detected in the flow rate of the portion of air coming from the gas turbine, then at least part of at least one of the two gas streams is recycled, towards the inlet of the separation unit.

According to other characteristics of the invention:

- at least part of each of the two gas streams is recycled towards the inlet of the separation unit;
- the appreciable decrease in the flow rate of the said portion of air coming from the gas turbine is detected by detecting when this flow rate falls below a predetermined value;
- the predetermined value corresponds to an instantaneous decrease of at least 5% in the flow rate of the portion of inlet air coming from the gas turbine;
- the appreciable decrease in the flow rate of the said portion of air coming from the gas turbine is detected by detecting a shutdown of the gas turbine;
- during normal operation of the gas turbine, substantially all the inlet air is supplied from the gas turbine;
- after having detected the appreciable decrease in the flow rate of the portion of air coming from the gas turbine, substantially all of the or each extracted gas stream is recycled towards the inlet of the separation unit;
- a portion of make-up air is dispatched, the flow rate of which is substantially less than the flow rate of the or each recycled gas stream;
- during normal gas turbine operation, only part of the inlet air is supplied from the gas turbine;
- after having detected the appreciable decrease in the flow rate of the portion of air coming from the gas turbine, only part of the or each extracted gas stream is recycled towards the inlet of the separation unit;
- a gasifier is fed by means of the other, non-recycled, part of the oxygen-rich gas stream which is not recycled;
- oxygen make-up is supplied to the gasifier, in addition to the said other part of the oxygen-rich gas stream;
- the other, non-recycled, part of the nitrogen-rich gas stream is discharged to the atmosphere.

The subject of the invention is also a plant for feeding an air separation unit by means of a gas turbine, comprising a gas turbine having means of supplying compressed air, in particular a compressor, an air separation unit comprising inlet air feed means, these feed means comprising at least first feed means, combined with the supply means of the gas turbine, together with first and second means, outside the said unit, of removing two gas streams respectively enriched with nitrogen and with oxygen, characterized in that it furthermore comprises means of recycling at least one of the two gas streams, capable of bringing at least the first or second removal means into communication with the air feed means of the air separation unit.

According to other characteristics of the invention:

- the recycling means are means of recycling each of the two gas streams, capable of bringing the first and second removal means into communication with the air feed means;
- the plant also comprises means of detecting an appreciable decrease in the flow rate of air flowing in the first feed means, these detection means being put in connection with the control means, in particular valves, capable of controlling the flow rates of gas flowing in the first and/or second removal means and the recycling means;
- the detection means comprise means for measuring the flow rate of air flowing in the first feed means;
- the detection means comprise means of detecting a shutdown of the gas turbine;
- the recycling means comprise at least one line, which connects the outlet of a compressor of a respective gas stream with the air feed means of the separation unit.

BRIEF DESCRIPTION OF THE DRAWINGS

The invention will be described below, with reference to the appended drawings given solely by way of non-limiting example, in which.

DESCRIPTION OF PREFERRED EMBODIMENTS

Figure 1:
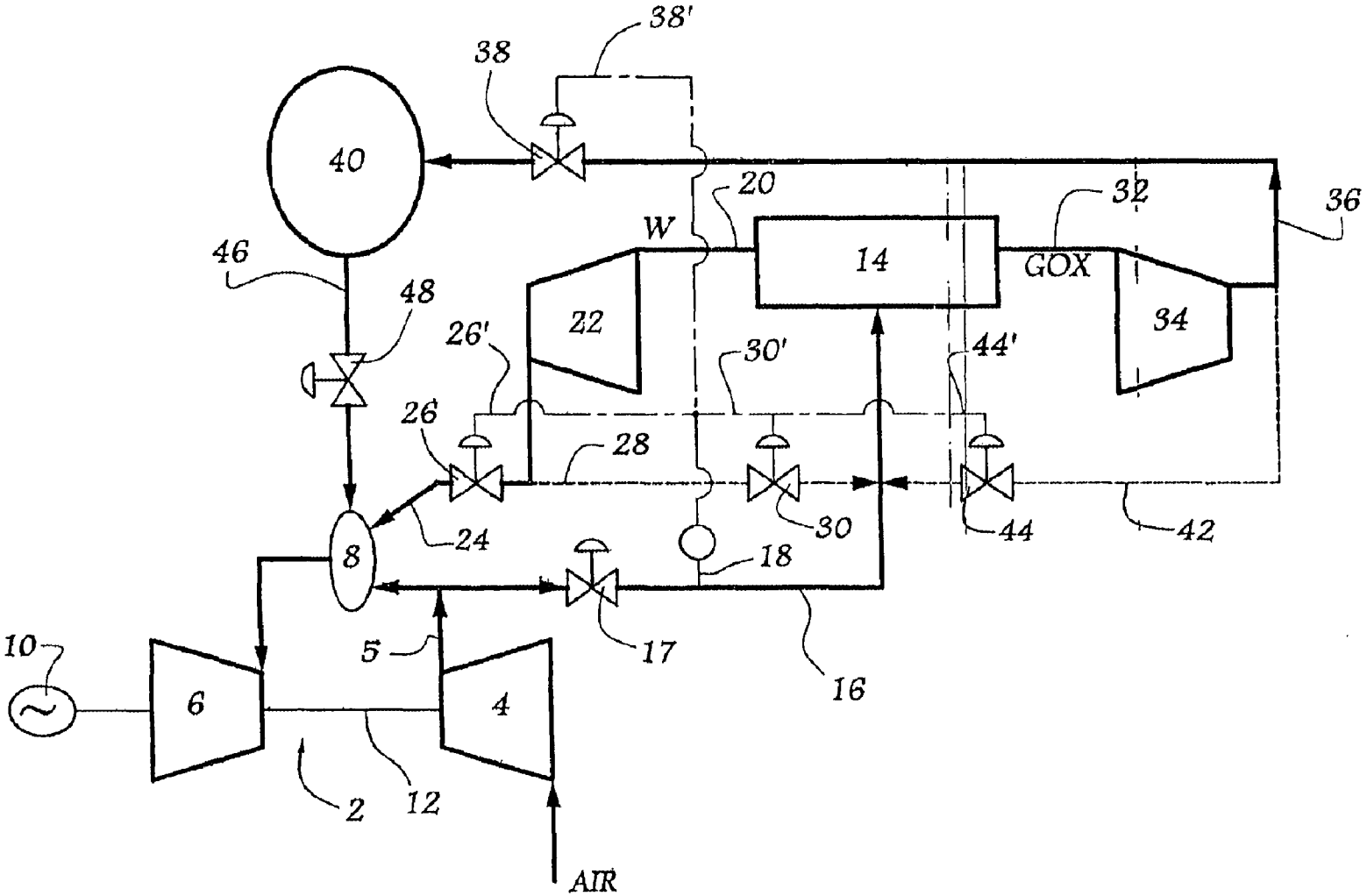
FIG. 1 is a schematic view, illustrating a plant according to a first embodiment of the invention, during normal operation of the gas turbine.
Figure 2:
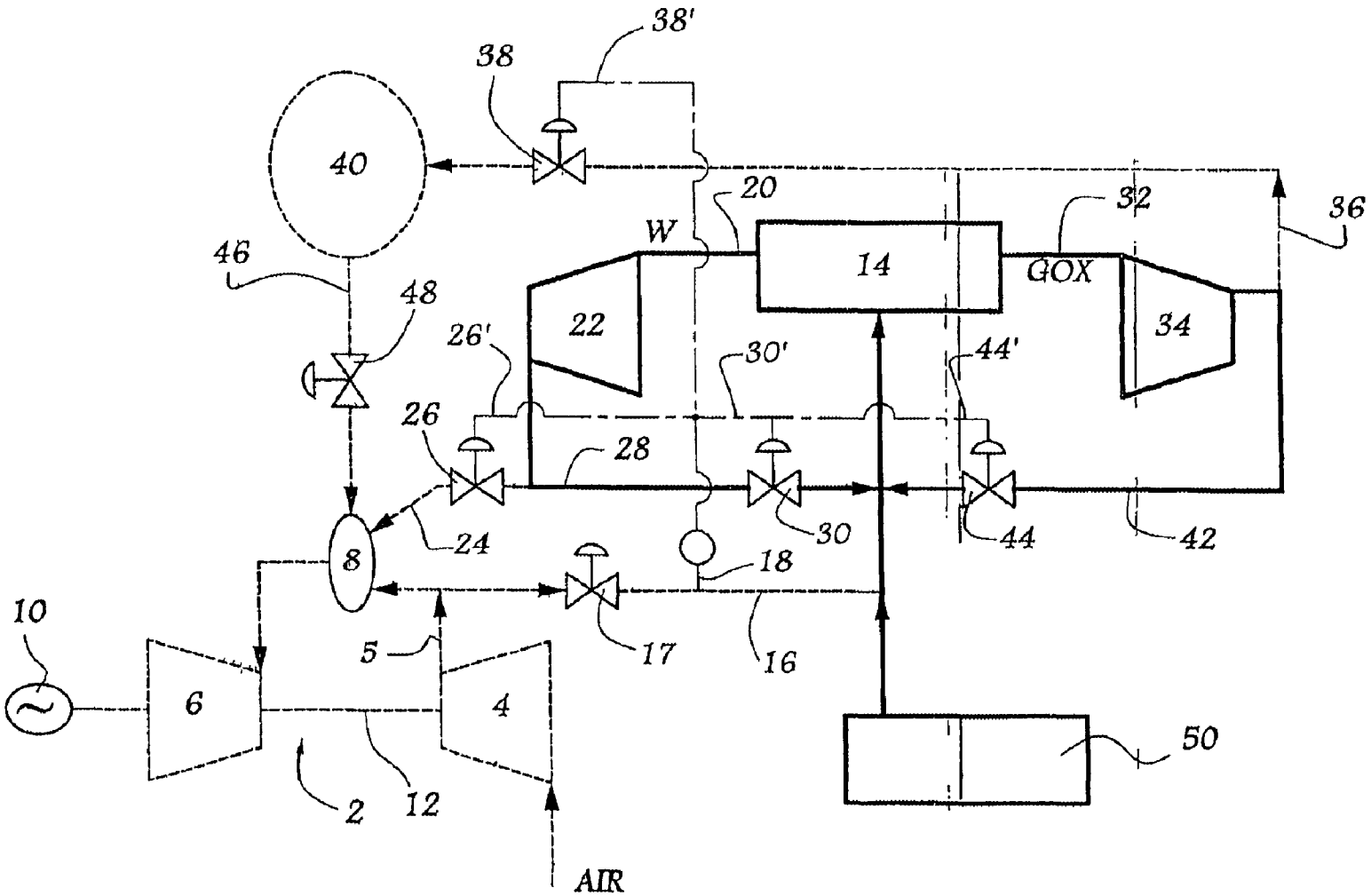
FIG. 2 is a view similar to FIG. 1, illustrating the plant of FIG. 1, when the gas turbine is shut down.

The plant shown in FIGS. 1 and 2 comprises a gas turbine, denoted overall by the reference 2, which conventionally comprises an air compressor 4, an expansion turbine 6 coupled to the compressor 4, and a combustion chamber 8. This gas turbine 2 is also provided with an alternator 10, driven by a shaft 12 common to the compressor 4 and to the turbine 6.

The plant of FIG. 1 also comprises an air separation unit, of known type, denoted overall by the reference 14. The inlet of this separation unit 14 is fed with air by a line 16, brought into communication with the delivery circuit 5 of the compressor 4.

This line 16 is equipped with a valve 17, and with a flow rate sensor 18. The separation unit operates cryogenically and comprises, for this purpose, several distillation columns (not shown).

A line 20, outside the unit 14, enables a first stream W of waste nitrogen to be extracted. This stream contains at least 90 mol %, preferably at least 95 mol % nitrogen, as well as a few percent oxygen.

This line 20 emerges in a compressor 22, downstream of which extends a line 24, which is provided with a valve 26 and emerges into the combustion chamber 8. A line 28, fitted with a valve 30, connects the lines 16 and 24.

Outside the unit 14, a line 32 enables an oxygen-rich gas stream GOX, which contains at least 70 mol %, preferably at least 80 mol %, oxygen to be extracted. This line 32 emerges in a compressor 34, downstream of which extends a line 36, fitted with a valve 38.

This line 36 emerges in a gasifier 40, of conventional type, which is fed by a tank (not shown) containing carbon products such as coal. A line 42, fitted with a valve 44, connects the line 16 and the line 36.

A line 46, which extends downstream of the gasifier 32, conveys the fuel gas arising from the aforementioned oxidation of the carbon products. This line 46, which is equipped with a valve 48, is brought into communication with the combustion chamber 8 of the gas turbine.

Moreover, the sensor 18 is put in connection with the valves 26, 30, 38 and 44, by the respective control lines, shown in dot-dash lines, which are allocated references 26', 30', 38' and 44'.

The operation of the aforementioned plant, during normal operation of the gas turbine 2, will be described below, with reference to FIG. 1.

The air separation unit 14 receives compressed air from the compressor 4 and conventionally produces two gas streams, respectively enriched with nitrogen and oxygen, which are conveyed by the line 20 and the line 32.

The oxygen-rich gas stream is admitted into the gasifier 40, which moreover receives the carbon products such as coal. The oxidation carried out in this gasifier 40 leads to the production of fuel gas, delivered by the line 46, which feeds the combustion chamber 8 of the gas turbine. The latter also receives, via the line 24, the nitrogen-enriched gas stream W, together with compressed air from the compressor 4, via the line 5.

The gases arising from the corresponding combustion, mixed with the waste nitrogen, are sent to the inlet of the expansion turbine 6, where they are expanded while driving the latter. This also enables the compressor 4 and the alternator 10, which for example feeds an electrical distribution network (not shown), to be driven via the shaft 12.

It should be noted that, during this normal operation of the turbine 2, the valves 26 and 38 are open, while the valves 30 and 44 are closed. As such, the line 16 is not fed either by the line 28 or by the line 42, which are thus shown in dotted lines.

When the gas turbine 2 detects an incident, especially due to a sudden variation in one of its parameters, this gas turbine shuts down, or undergoes an appreciable malfunction. As such, the flow rate of compressed air flowing in the line 16 is subjected to an appreciable decrease.

When this decrease in the flow rate is greater than a predetermined value, which corresponds for example to an instantaneous drop of at least 5%, the sensor 18 detects this drop in flow rate. It then sends signals to the valves 26, 30, 38 and 44, via the control lines 26', 30', 38' and 44'.

The changeover of these four valves may also be initiated by means of a sensor (not shown) indicating the shutdown of the turbine.

This then causes valves 30 and 44, initially closed, to open and the valves 26 and 38, initially open, to close. In this way, the oxygen-enriched stream no longer feeds the gasifier via the line 36, while the nitrogen-enriched stream no longer feeds the combustion chamber 8, via the line 24.

Instead, these two gas streams are recycled towards the inlet of the air separation unit 14, via the line 28 and the line 42.

The nitrogen-enriched stream, which may be filled with impurities, is advantageously recycled upstream of a conventional purification device. This recycled stream may also undergo prior cooling, before being admitted into the separation unit 14.

On the other hand, the oxygen-enriched stream may be delivered to the inlet of this unit 14 without being subjected to purification or to cooling.

It should be noted that the mixture of these two streams, enriched respectively with nitrogen and with oxygen and, admitted to the inlet of the unit 14, has a composition close to that of air.

Also, assuming the gas turbine would still be operating, although detecting an incident, its complete shutdown is carried out.

In FIG. 2, the line 24, the lines 36 and 46 and the gas turbine 2 are shown in dotted lines. On the other hand, the line 28 and the line 42 are shown in solid lines.

Given that as soon as the separation unit 14 is no longer sufficiently fed by the compressor 4, the two gas streams are recycled, via the line 28 and the line 42, towards the inlet of this unit 14, the latter does not undergo a sudden variation in its inlet flow rate. The latter may thus be kept constant, or be gradually decreased, by reducing the load of this separation unit 14.

It should be noted that, during the phase of recycling the two aforementioned gas streams towards the inlet of the separation unit 14, it is possible to resort to a make-up compressor 50, which can be seen in FIG. 2. The latter thus makes it possible to compensate for gas losses, associated with recycling of this sort.

This compressor 50 may also be used to start up the separation unit 14, without resorting to the gas turbine 2, which enables this turbine and this separation unit to be started up in parallel, as required. This make-up compressor 50 is capable of having a very small size, such that it is of low cost and does not involve much energy expenditure.

When the gas turbine is again able to operate normally, the various valves 26, 30, 38 and 44 are placed in their initial configuration. This enables the plant to be set up again in its arrangement of FIG. 1.

Figure 3:
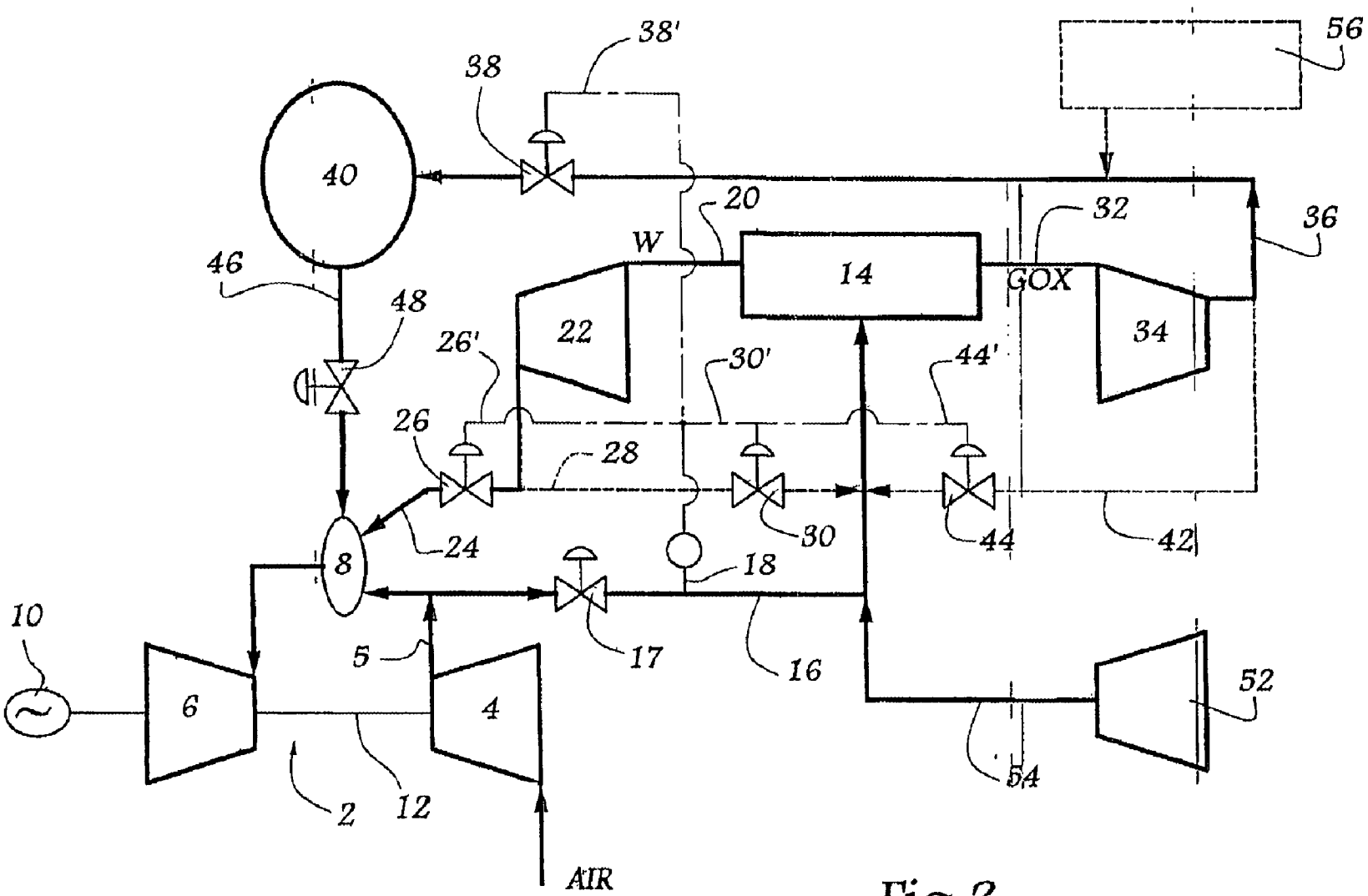
FIG. 3 is a view similar to FIG. 1, illustrating a plant according to a second embodiment of the invention, during normal operation of the gas turbine.
Figure 4:
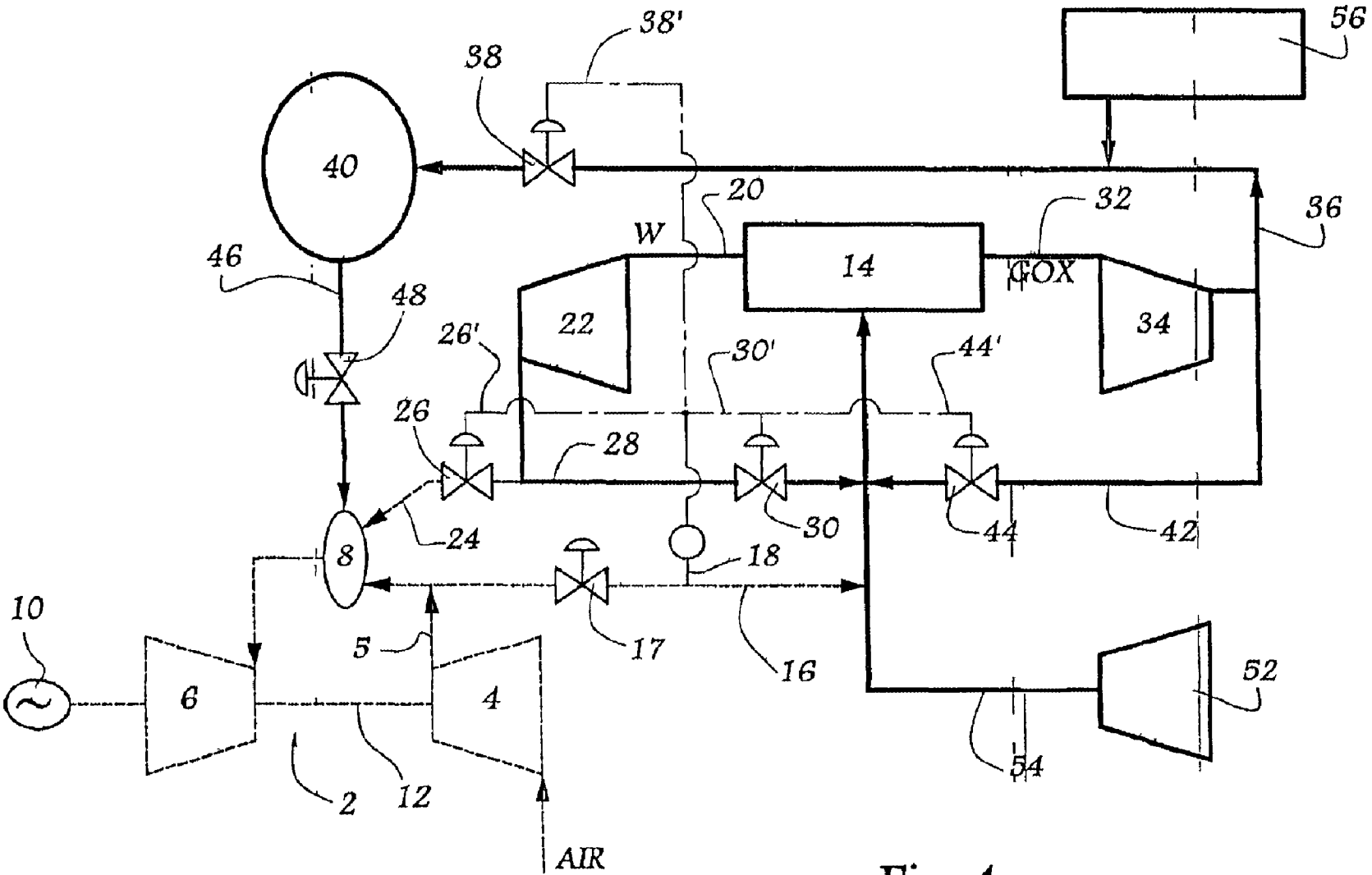
FIG. 4 is a view similar to FIG. 3, illustrating the plant of FIG. 3 when the gas turbine is shut down.

FIGS. 3 and 4 show a second embodiment of the plant according to the invention.

This variation differs from the plant shown in FIG. 1, in that it is provided with a compressor 52, allowing the separation unit 14 to be fed with air via a line 54.

During normal operation of the gas turbine 2, operation of the plant is identical to that described with reference to FIG. 1, given that the compressor 52, in combination with the compressor 4 of the gas turbine 2, enables the separation unit 14 to be fed with air.

On occurrence of an incident at this gas turbine 2, the reduction in air flow rate in the line 16 is detected, in a similar manner to that described above. The valves 26 and 38 are then closed, and the valves 30 and 44 are opened so as to recycle the gas streams conveyed by the line 28 and the line 42 to the inlet of the separation unit 14.

It should be noted that these gas streams are recycled only in part, so as to compensate only for the lack of feed by the compressor 4 of the turbine 2, given that the external compressor 52 continues to direct the air towards the separation unit 14.

Also, it should be noted that the mixture of the air coming from the compressor 52 and the two gas streams respectively enriched with nitrogen and with oxygen, has a composition close to that of air.

The other portion of the oxygen-rich gas stream, which is not recycled, is sent to the gasifier 40, in a manner similar to the arrangement of FIG. 3. Also, a unit 56 is provided, enabling oxygen make-up to be supplied, such that the flow rate of oxygen admitted at the inlet of the gasifier is not subjected to a sudden decrease. This makes it possible not to shut down this gasifier, which is advantageous in terms of savings in time and in energy consumption.

The portion of nitrogen which is not recycled, flowing via the line 24, is discharged to the atmosphere. The valve 26 is closed, while the gas turbine is shut down.

Given that part of the nitrogen- and oxygen-enriched gas streams are recycled via the line 28 and the line 42, this makes it possible to prevent any sudden decrease in the flow rate of air admitted to the inlet of the separation unit 14.

The respective loads of the separation unit 14 and of the gasifier 40 can be progressively decreased, once these recycling operations are implemented. In this way, it is possible to reduce the flow rate of the gas streams recycled via the line 28 and the line 42 progressively, and also the flow rate of oxygen provided by the make-up unit 56. Once this recycling is stopped, the gasifier can again be fed just by the oxygen flowing in the line 36.

When the gas turbine is able to operate normally again, the various valves are placed in their initial configurations, such that the plant returns to its arrangement of FIG. 3.

The invention enables the aforementioned objectives to be achieved.

This is because the applicant has noticed that the loss in purity in the products extracted from the separation unit, and the inopportune shutdowns of the latter, are mainly due to the sudden decreases in the flow rate of air admitted to the inlet of this separation unit. Now, such sudden decreases are connected to the malfunctions, or even to the shutdown of the gas turbine, the compressor thereof then no longer feeding the separation unit.

Recycling at least part of each of the gas streams which are extracted therefrom towards the inlet of the separation unit enables any appreciable fluctuation of this inlet air flow rate to be prevented. Thus, it is possible to keep the latter constant, or to decrease it progressively, such that satisfactory operation of this separation unit is permanently guaranteed.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of feeding an air separation unit by means of a gas turbine, comprising:

a) providing an air separation unit, wherein said air separation unit has an air inlet, b) providing a gas turbine, wherein said gas turbine has a compressor section, c) admitting air into said air inlet of said air separation unit, wherein at least a portion of said inlet air is supplied from said compressor section of said gas turbine, d) extracting at least two gas streams wherein one stream is enriched with nitrogen and one stream is enriched with oxygen from said separation unit, e) detecting a decrease in the flow rate of the portion of air coming from said gas turbine, and f) recycling at least part of at least one of said two gas streams back into the inlet of said separation unit.

2. The method according to claim 1, wherein at least part of each of said two gas streams are recycled back into the inlet of said air separation unit.

3. The method according to claim 1, wherein said decrease in the flow rate of said portion of air coming from said gas turbine is detected when said flow rate falls below a predetermined value.

4. The method according to claim 3, wherein said predetermined value corresponds to an instantaneous decrease of at least 5% in the flow rate of said portion of inlet air coming from said gas turbine.

5. The method according to claim 1, wherein said appreciable decrease in the flow rate of said portion of air coming from said gas turbine is detected by a shutdown of said gas turbine.

6. The method according claim 1, wherein substantially all of said inlet air is supplied by said gas turbine.

7. The method according to claim 6, wherein substantially all of said extracted gas streams are recycled back into said inlet of said air separation unit.

8. The method according to claim 7, wherein additional air is introduced into said air separation unit, the flow rate of which is substantially less than said flow rate of said recycled gas streams.

9. The method according to claim 1, wherein only part of said inlet air is supplied from said gas turbine.

10. The method according to claim 9, wherein a first recycle stream comprises a portion of said extracted gas stream, is recycled back into said inlet of said air separation unit, after having detected said decrease in said flow rate of said portion of air coming from said gas turbine.

11. The method according to claim 10, wherein said first recycle stream comprises an oxygen-rich gas stream and a nitrogen-rich gas stream.

12. The method according to claim 11, wherein a second recycle stream consisting of a portion of said extracted oxygen-rich gas stream that was not originally recycled, is fed into a gasifier.

13. The method according to claim 12, wherein additional oxygen is supplied to said gasifier, in addition to said second recycle stream.

14. The method according to claim 12, wherein a third recycle stream comprises a portion of said extracted nitrogen-rich gas stream that was not originally recycled, is discharged to the atmosphere.

15. An apparatus for feeding an air separation unit, comprising:

a make-up supply means, a gas turbine compressed air supply means, a first feed means comprised of at least said make-up supply means and said gas turbine compressed air supply means, a first removal means for extracting an oxygen-rich gas stream from said air separation unit, a first recycle means, consisting of at least a portion of said oxygen-rich gas stream, a second removal means for extracting a nitrogen rich gas stream from said air separation unit, a second recycle means, consisting of at least a portion of said nitrogen-rich gas stream, and an inlet air feed means comprising at least said first feed means, and at least one of said first recycle means or said second recycle means.

16. The apparatus according to claim 15, further comprising:

a detection means of detecting an appreciable decrease in the flow rate of air flowing in said first feed means, a first control means of controlling the flow rate of gas flowing in said first removal means, a second control means of controlling the flow rate of gas flowing in said second removal means, a third control means of controlling the flow rate of gas flowing in said first recycle means, a fourth control means of controlling the flow rate of gas flowing in said second recycle means, wherein said detection means is capable of controlling at least one of said first, second, third or fourth control means.

17. The apparatus according to claim 16, wherein said detection means comprises a means of detecting a shutdown of the gas turbine.

18. The apparatus according to claim 15, wherein at least one of said first recycling means or said second recycling means further comprises at least one line, which is connected to the outlet of a compressor of a respective gas stream with said first feed means.

* * * * *